US005887219A

United States Patent [19]

Eom

[11] Patent Number: 5,887,219

[45] Date of Patent: Mar. 23, 1999

[54] TRANSFER VOLTAGE CONTROLLING METHOD AND APPARATUS OF IMAGE FORMING APPARATUS

[75] Inventor: Yoon-seop Eom, Suwon, Rep. of Korea

[73] Assignee: Samsung Electronics Co., Ltd., Kyungki-Do, Rep. of Korea

[21] Appl. No.: 73,764

[22] Filed: May 7, 1998

[30] Foreign Application Priority Data

Aug. 26, 1997 [KR] Rep. of Korea ..... 97-41192

[51] Int. Cl.[6] ..... G03G 13/14; G03G 15/14; G03G 21/00

[52] U.S. Cl. ..... 399/45; 399/66

[58] Field of Search ..... 399/45, 66; 430/126

[56] References Cited

U.S. PATENT DOCUMENTS

| | | | |
|---|---|---|---|
| 5,140,375 | 8/1992 | Shindo et al. | 399/45 |
| 5,568,228 | 10/1996 | Tombs | 399/66 X |
| 5,652,943 | 7/1997 | Matsuo | 399/45 X |
| 5,717,980 | 2/1998 | Oka et al. | 399/66 |

*Primary Examiner*—Fred L Braun
*Attorney, Agent, or Firm*—Sughrue, Mion, Zinn, Macpeak & Seas, PLLC

[57] ABSTRACT

A transfer voltage controlling apparatus of an image forming apparatus includes a high voltage unit installed at one side of a sheet for generating a magnetic field around the sheet by applying a high voltage to the sheet, a conductor unit installed at the other side of the sheet for forming an induced current by the magnetic field transmitted through the sheet, an A/D converter for converting an analog signal of the current induced to the conductor unit into a digital signal, a microcontroller for receiving the output signal of the A/D converter, comparing the received signal with a reference signal to detect thickness of the sheet, and generating a control command of the transfer voltage corresponding to the thickness of the sheet, and a high voltage controller for receiving the control command from the microcontroller and applying the transfer voltage having a predetermined magnitude to a transfer unit. Since the transfer voltage applied to a transfer unit is varied/controlled according to the thickness of the sheet as well as the ambient temperature and humidity, the transfer efficiency can be enhanced and a better quality image can be obtained, accordingly.

10 Claims, 3 Drawing Sheets

TRANSFER VOLTAGE CONTROLLING METHOD AND APPARATUS OF IMAGE FORMING APPARATUS

BACKGROUND OF THE INVENTION

1. Field of the Invention

The present invention relates to a method and apparatus for controlling a transfer voltage of an image forming apparatus, and more particularly, to a method and apparatus which measures the thickness of a supplied sheet to thereby vary and control the transfer voltage.

The present application is based on Korean priority application 97-41192 which is incorporated herein by reference.

2. Description of the Related Art

An image forming apparatus reproduces characters or images onto a recording medium according to transferred character or picture image data signals, and generally includes a photoreceptor member (e.g., a photoreceptor drum or a photoreceptor belt) for forming a latent electrostatic image, a charging means for charging the photoreceptor member, an exposing unit for forming a latent electrostatic image having a predetermined pattern by scanning light onto the charged photoreceptor member, a developing unit for developing the latent electrostatic image by supplying a developing medium (e.g., a toner or a developer liquid) on the exposed latent electrostatic image, and a transfer unit for transferring the developed image to the recording medium by applying pressure or heat.

Referring to FIG. 1 showing a general image forming apparatus, the image forming apparatus including a photoreceptor belt 104 installed to be capable of moving circulatively by first, second and third belt rollers 101, 102 and 103, a discharger 105 for removing charges remaining on the photoreceptor belt 104, a charger 106 for newly generating the charges on the photoreceptor belt 104, exposing units 107, 108, 109 and 110 each having a laser scanning unit (not shown) for scanning a laser beam for the purpose of selectively discharging the image forming portion of the photoreceptor belt 104 to be formed, into an image-shaped pattern, developing units 111, 112, 113 and 114 for respective colors yellow (Y), magenta (M), cyan (C) and black (K), for developing the latent electrostatic image formed on the photoreceptor belt 104, a drier 115 for drying the developer liquid supplied to the latent electrostatic image, and a transfer unit 116 for transferring an arbitrarily developed image formed on the photoreceptor belt 104 to a recording medium 117 such as a sheet of paper or a film.

Here, the developing unit 111 includes a developing roller 111*a* for coating the developer liquid on the photoreceptor belt 104, a developer liquid supplier 111*b* for supplying the developer liquid to the developing roller 111*a*, a cleaning roller 111*c* for removing the developer liquid embedded on the rear surface of the developing roller 111*a*, first and second squeegee rollers 111*d* and 111*e* for removing the developer liquid remaining in the photoreceptor belt 104, first and second blades 111*f* and 111*g* for removing the developer liquid embedded on the first and second squeegee rollers 111*d* and 111*e*, and a developer liquid recovery container 111*h* for recovering the developer liquid removed by the cleaning roller 111*c* and blades 111*f* and 111*g*. The drier 115 includes a heating roller 115*h* for drying the developer liquid embedded on the photoreceptor belt 104. The transfer unit 116 includes a transfer roller 116*t* pressing closely against the first belt roller 101 and rotating reciprocally thereto, with the photoreceptor belt 104 interposed between the transfer roller 116*t* and the first belt roller 101 for receiving the image from the photoreceptor belt 104, and a fixing roller 116*p* pressing closely against the transfer roller 116*t* and rotating reciprocally thereto for fixing the image transferred to the transfer roller 116*t* on the recording sheet 117 interposed therebetween.

In the image forming apparatus having the aforementioned configuration, conventionally the transfer conditions are controlled by detecting only the ambient temperature and humidity. Thus, if the thicknesses of sheets used are different (e.g., if the sheets become thicker) the transfer efficiency is lowered, thereby precluding the attainment of a good quality image. If a transfer voltage is increased to a predetermined level or higher in order to solve this problem, a photoreceptor belt may be damaged by arc discharge and a great deal of ozone ($O_3$) may be generated.

SUMMARY OF THE INVENTION

To solve the problems of the system discussed above, it is an object of the present invention to provide a method and apparatus for controlling a transfer voltage of an image forming apparatus which can obtain a good quality image by measuring the thicknesses of sheets and transferring an image under varying transfer conditions depending on the measured thicknesses Accordingly, to achieve the above object, there is provided a transfer voltage controlling method of an image forming apparatus comprising the steps of: picking up a sheet and forming a magnetic field around the sheet by applying a voltage at one side of the sheet; detecting an induced voltage at the other side of the sheet induced by the magnetic field transmitted through the sheet; detecting the thickness of the sheet based on the detected induced voltage; and controlling a transfer voltage corresponding to the detected thickness of the sheet.

Before controlling the transfer voltage, there is further provided the step of: searching transfer voltage values corresponding to the detected thicknesses of the sheet from a prepared table demonstrating transfer voltage values corresponding to various thicknesses of the sheet.

According to another aspect of the present invention, there is provided a transfer voltage controlling apparatus comprising: a high voltage unit installed at one side of a sheet for generating a magnetic field around the sheet by applying a high voltage to the sheet; a conductor unit installed at the other side of the sheet for forming an induced current by the magnetic field transmitted through the sheet; an A/D converter for converting an analog signal of the current induced in the conductor unit into a digital signal; a microcontroller for receiving the output signal of the A/D converter, comparing the received signal with a reference signal to detect thickness of the sheet, and generating a control command of the transfer voltage corresponding to the thickness of the sheet; and a high voltage controller for receiving the control command from the microcontroller and applying the transfer voltage having a predetermined magnitude to a transfer unit. Preferably, a separate overhead projector (OHP) film sensing means is further provided at one side of the sheet.

According to the present invention, the transfer voltage applied to a transfer device is varied and controlled depending on the thicknesses of sheets as well as the ambient temperature and humidity. Therefore, the transfer efficiency can be enhanced and a better quality image can obtained, accordingly.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
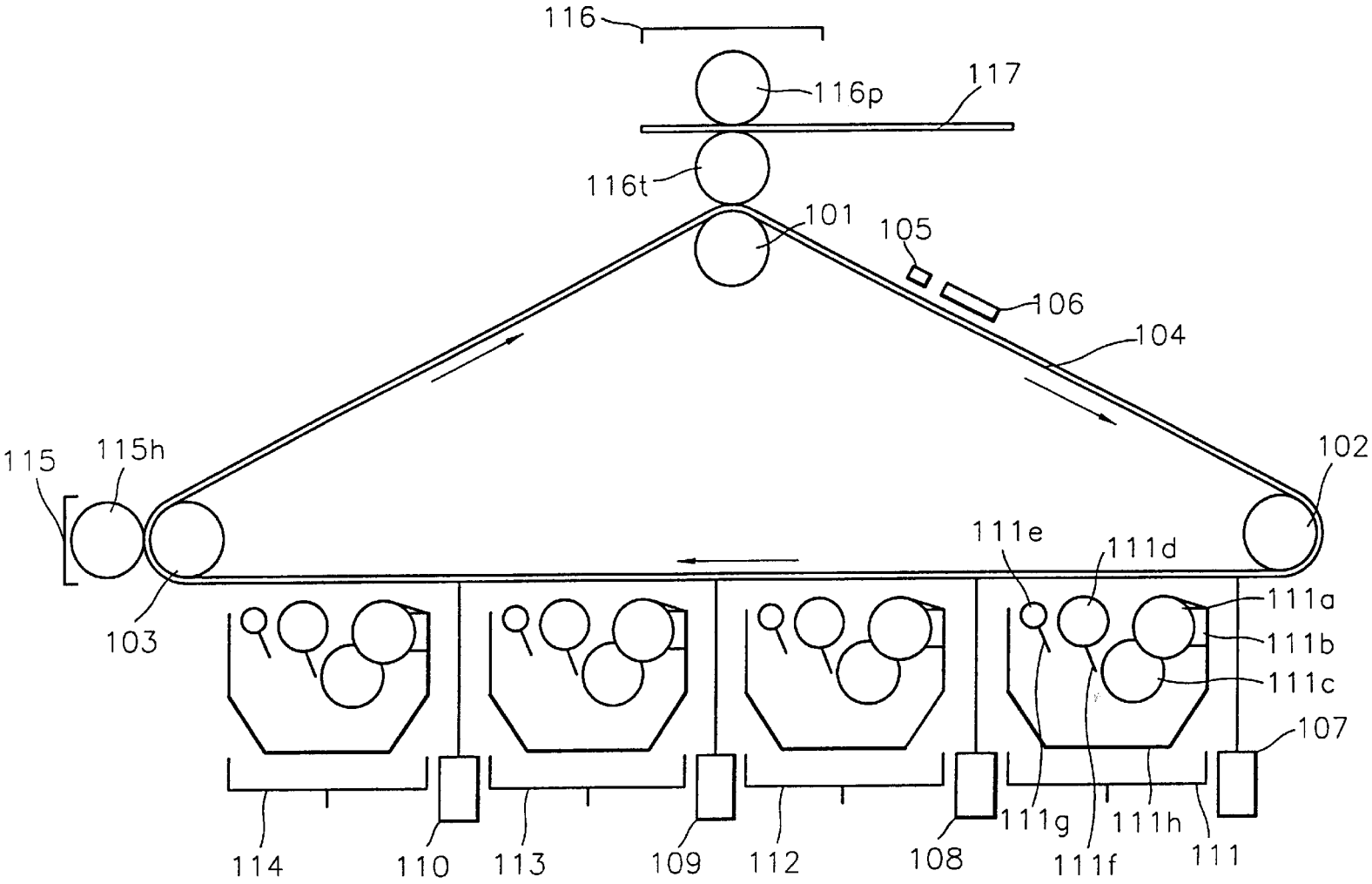
FIG. 1 is a schematic diagram of a general image forming apparatus.
Figure 2:
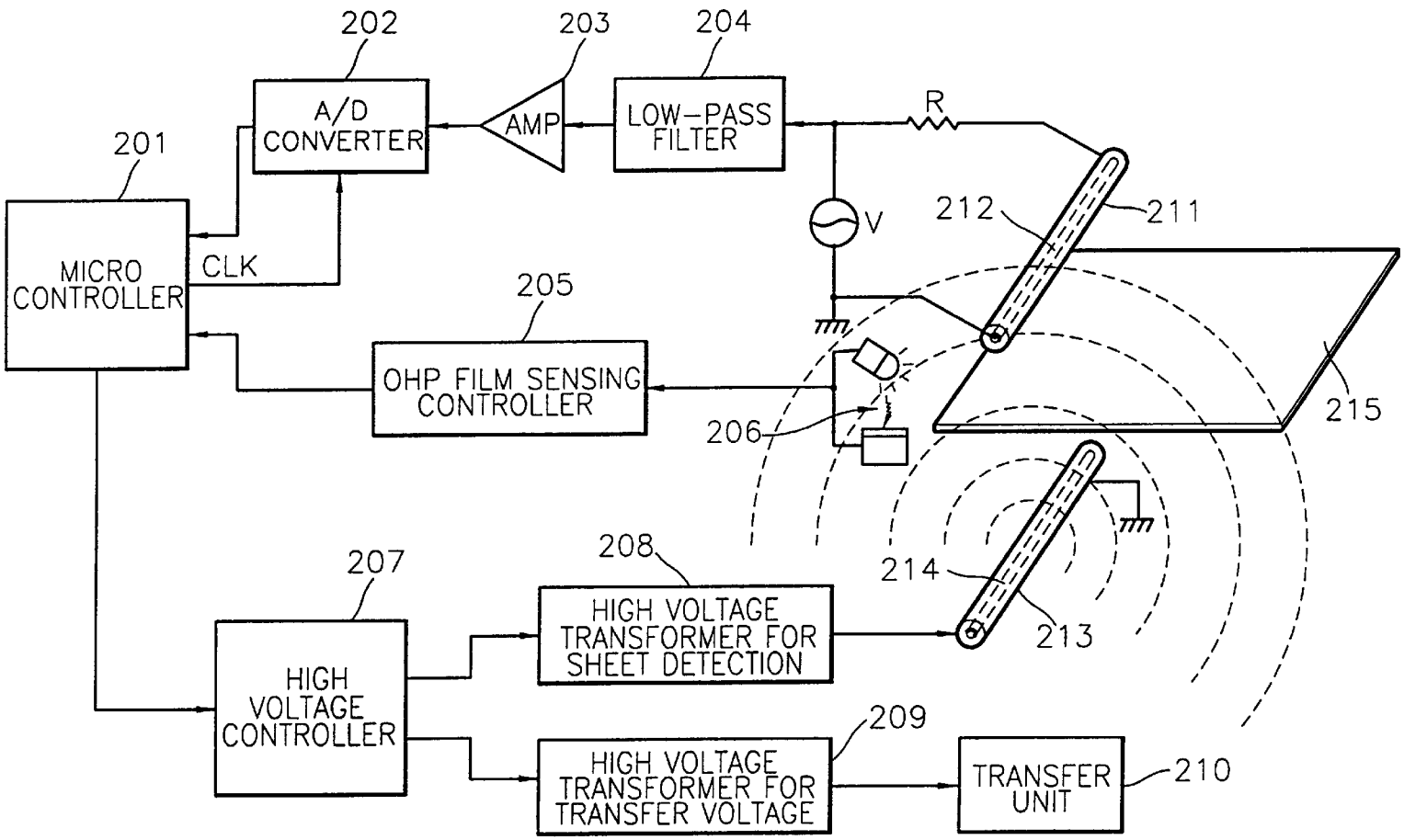
FIG. 2 is a schematic system diagram of a transfer voltage controller of an image forming apparatus according to the present invention.

Referring to FIG. 2, the transfer voltage controller of an image forming apparatus according to the present invention includes a high voltage unit 213 installed at one side of a sheet 215 for forming a magnetic field around the sheet 215 by application of a high voltage, a conductor unit 211 installed at the other side of the sheet 215 in which a current is induced by the magnetic field transmitted through the sheet 215, an A/D converter 202 for converting an analog signal of the current induced to the conductor unit 211 into a digital signal, a microcontroller 201 for receiving the output signal of the A/D converter 202 and comparing the received signal with a reference signal to detect thickness of the sheet 215, and generating a control command of the transfer voltage corresponding to the thickness of the sheet 215, and a high voltage controller 207 for receiving the control command from the microcontroller 201 and applying the transfer voltage having a predetermined magnitude to a transfer unit 210.

Here, a low-pass filter 204 for attenuating radio frequency components mixed with the induced current and an amplifier 203 for amplifying the waveform of the induced current having passed through the low-pass filter 204 are preferably provided between the conductor unit 211 and the A/D converter 202. Particularly, at one side of the sheet 215, there are provided a photosensor 206 as an overhead projector (OHP) film sensing means and an OHP film sensing controller 205 for receiving a signal sensed by the photosensor 206 and transmitting the same to the microcontroller 201.

A high voltage transformer 208 for sheet detection is provided between the high voltage unit 213 and the high voltage controller 207, and another high voltage transformer 209 for a transfer voltage is provided between the high voltage controller 207 and the transfer unit 210. Here, a device for performing a high voltage control adopting a pulse width modulation (PWM) method is used as the high voltage controller 207. Reference numerals 212 and 214 represent wires.

Next, the procedure for controlling a transfer voltage using the aforementioned transfer voltage controller of an image forming apparatus according to the present invention will be described with reference to FIGS. 2 and 3.

Figure 3:
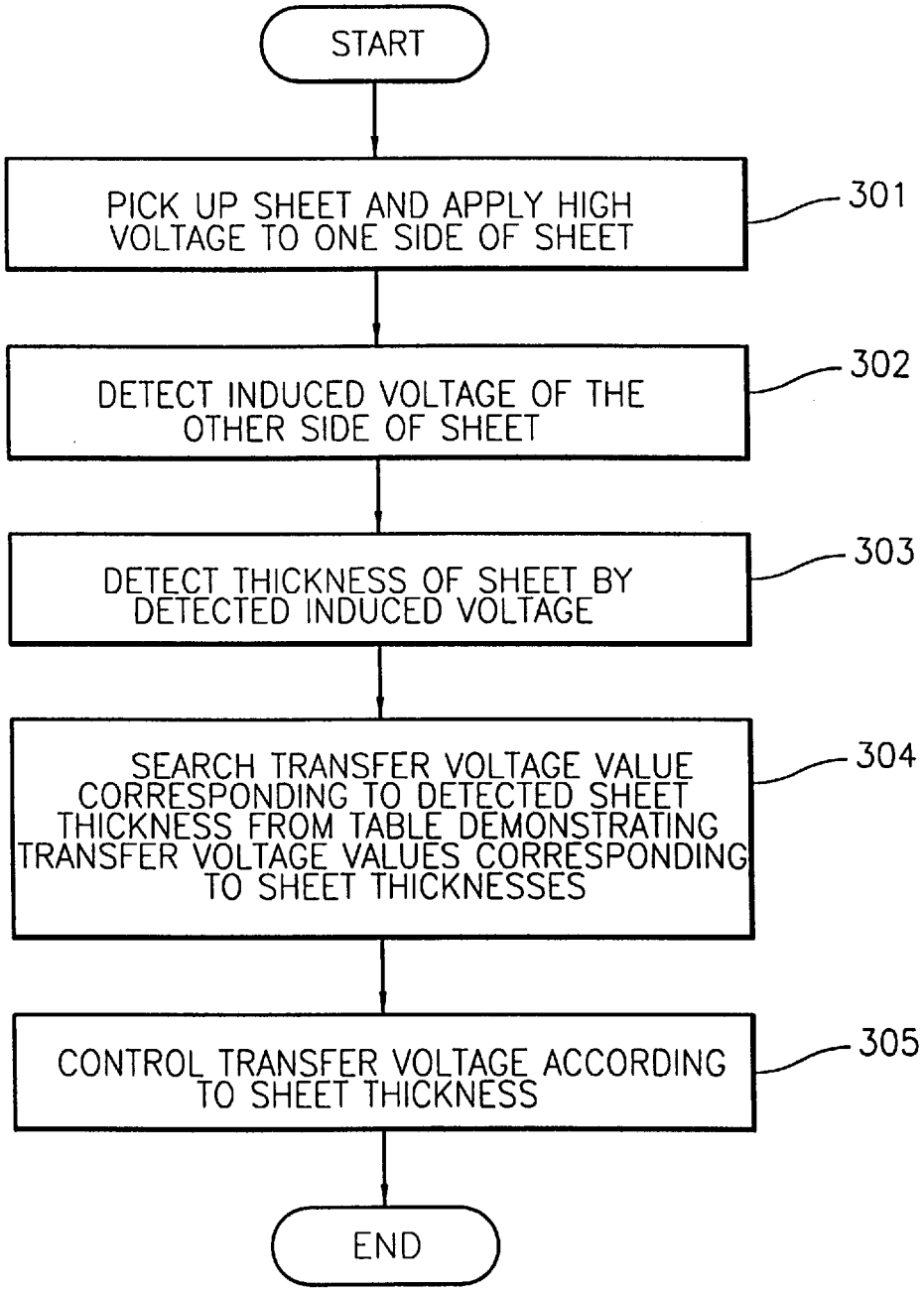
FIG. 3 is a flow chart for explaining the executive procedure of a method for controlling a transfer voltage of an image forming apparatus according to the present invention.

Referring to FIGS. 2 and 3, the sheet 215 is first picked up by the image forming apparatus and a voltage is applied to the high voltage unit 213 on one side of the sheet 215, thereby forming a magnetic field around the sheet 215 (step 301). In other words, a high voltage is applied to one side (the lower surface of the sheet 215 shown in FIG. 2) of the sheet 215 through the high voltage unit 213, thereby forming a concentric magnetic field as indicated by dotted lines around the internal wire 214 of the high voltage unit 213.

As the magnetic field is formed in such a manner by applying the high voltage, a voltage is induced in the conductor unit on the other side of the sheet 215 by the magnetic field transmitted through the sheet 215 (the upper surface thereof shown in FIG. 2) and is then detected (step 302). In other words, the magnetic field transmitted through the sheet 215 is interlinked with the internal wire 212 of the conductor unit 211 on the upper surface of the sheet 215. As a result, a current is induced in the internal wire 212 of the conductor unit 211. The induced current causes a voltage drop while passing through a resistance R and the value of the voltage drop is indicated in a voltmeter V as having an arbitrary magnitude. Radio frequency components mixed with the induced current are eliminated by the low-pass filter 204 and the analog signal of the induced voltage whose waveform is amplified by the amplifier 203 is converted into a digital signal by the A/D converter 202 to then be input to the microcontroller 201. The microcontroller 201 then analyzes the input digital signal to detect the induced voltage. The detected induced voltage is compared with reference data to detect the thickness of the sheet 215 (step 303). Thereafter, the microcontroller 201 searches transfer voltage values corresponding to the detected thicknesses of the sheet 215 from a table demonstrating transfer voltage values corresponding to various thicknesses of sheets (step 304). Here, the transfer voltage value table is provided by obtaining operator's experimental data and pre-storing the same in a memory in the microcontroller 201.

As the sheet thickness is detected in such a manner, the transfer voltage corresponding to the detected sheet thickness is controlled (step 305). More particularly, the microcontroller 201 detects the transfer voltage value corresponding to the detected sheet thickness, and a control command therefor is transferred to the high voltage controller 207. The high voltage controller 207 then varies/controls transfer voltages applied to the transfer unit 210 according to the control command. In other words, the transfer conditions are varied according to the thicknesses of sheets. Accordingly, a constant image having a good quality is finally obtained irrespective of the thickness of the sheet 215. Although not described herein, the varying and controlling of transfer voltages are also carried out in consideration of the ambient temperature and humidity.

Throughout the above-described sequential procedure, if the sheet 215 is an OHP film, the OHP film is sensed by the photosensor 206 and the sensed signal is transmitted to the microcontroller 201 via the OHP film sensing controller 205. The microcontroller 201 compares the sensed signal with a reference signal and analyzes the same to then search the transfer conditions. The result is transmitted to the high voltage controller 207 which, in turn, varies/controls the transfer voltages applied to the transfer unit 210 in accordance with the received control command similar to the case when a plain sheet is supplied.

Since the transfer voltage applied to the transfer unit is varied/controlled according to the thickness of the sheet, as well as the ambient temperature and humidity, the method and apparatus of the present invention thereby affords an enhanced transfer efficiency and a better quality image.

While the present invention has been described and illustrated with reference to a preferred embodiment thereof, it is to be readily understood that the present invention is not limited to the embodiment, and various changes and modifications can be made therein without departing from the spirit and scope of the invention defined in the appended claims.

What is claimed is:

1. A transfer voltage controlling method of an image forming apparatus comprising the steps of:

picking up a sheet and forming a magnetic field around the sheet by applying a voltage at one side of the sheet;

detecting an induced voltage present on the other side of the sheet induced by the magnetic field transmitted through the sheet;

detecting a thickness of the sheet based on the detected induced voltage; and controlling a transfer voltage corresponding to the detected thickness of the sheet.

2. The method according to claim 1, before controlling the transfer voltage, further comprising the step of:

searching transfer voltage values corresponding to the detected thicknesses of the sheet from a prepared table demonstrating transfer voltage values corresponding to various thicknesses of the sheet.

3. A transfer voltage controlling apparatus comprising:

a high voltage unit installed at one side of a sheet for generating a magnetic field around the sheet by applying a high voltage to the sheet;

a conductor unit installed at the other side of the sheet for forming an induced current by the magnetic field transmitted through the sheet;

an A/D converter for converting an analog signal of the current induced to the conductor unit into a digital signal;

a microcontroller for receiving the output signal of the A/D converter, comparing the received signal with a reference signal to detect thickness of the sheet, and generating a control command of the transfer voltage corresponding to the thickness of the sheet; and a high voltage controller for receiving the control command from the microcontroller and applying the transfer voltage having a predetermined magnitude to a transfer unit.

4. The apparatus according to claim 3, further comprising:

a low-pass filter for attenuating radio frequency components mixed with the induced current between the conductor unit and the A/D converter.

5. The apparatus according to claim 3, further comprising:

an amplifier for amplifying the waveform of the induced current between the conductor unit and the A/D converter.

6. The apparatus according to claim 3, further comprising:

an overhead projector (OHP) film sensing means provided at one side of the sheet.

7. The apparatus according to claim 6, wherein the OHP film sensing means includes a photosensor and an OHP film sensing controller for receiving a signal sensed by the photosensor and transmitting the same to the microcontroller.

8. The apparatus according to claim 3, further comprising:

a high voltage transformer for sheet detection provided between the high voltage unit and the high voltage controller.

9. The apparatus according to claim 3, further comprising:

a high voltage transformer disposed between the high voltage controller and the transfer unit for applying the transfer voltage from the high voltage controller to the transfer unit.

10. The apparatus according to claim 3, wherein the high voltage controller performs a high voltage control adopting a pulse width modulation (PWM) method.

* * * * *